United States Patent [19]

Makiura

[11] Patent Number: 4,911,568

[45] Date of Patent: Mar. 27, 1990

[54] PRINTER

[75] Inventor: Takashi Makiura, Yamatotakada, Japan

[73] Assignee: Sharp Kabushiki Kaisha, Osaka, Japan

[21] Appl. No.: 222,788

[22] Filed: Jul. 22, 1988

[30] Foreign Application Priority Data

Jul. 24, 1987 [JP] Japan ..... 62-186326

[51] Int. Cl.[4] ..... B41J 1/22

[52] U.S. Cl. ..... 400/144.2; 400/157.3; 400/157.1; 101/93.28; 101/93.48

[58] Field of Search ..... 400/167, 157.1, 157.2, 400/704, 435, 157.3, 166, 144.2, 322, 279; 101/93.02, 93.28, 93.48

[56] References Cited

U.S. PATENT DOCUMENTS 4,523,867 6/1985 Berrey et al. ..... 400/167 X 4,547,087 10/1985 Heider et al. ..... 400/167 X 4,569,607 2/1986 Takemoto ..... 400/167

FOREIGN PATENT DOCUMENTS 110274 6/1983 Japan ..... 400/167

OTHER PUBLICATIONS

IBM Tech. Disc. Bulletin, "Print Hammer Settle Control", Westcott, vol. 24, No. 4, Sep. 1981, pp. 2131–2132.

*Primary Examiner*—Edgar S. Burr

*Assistant Examiner*—Joseph R. Keating

[57] ABSTRACT

A printer comprises a type wheel, a hammer to hit a wheel, an ink ribbon, a carriage, a detector for detecting first and second positions of the hammer, and a controller responsive to the detector for generating the first and the second control signals to independently drive the type wheel, the ink ribbon, and the carriage.

7 Claims, 4 Drawing Sheets

PRINTER

BACKGROUND OF THE INVENTION

The present invention relates to a printer, and more particularly, to a printer used in, for example, an electronic typewriter.

Conventionally, in an apparatus such as an electronic typewriter which carries out printing by typing, a type wheel is, for example, employed in which type faces of the same standardized size are respectively arranged around heads of a support shaped into a form of a vane wheel. This type wheel is driven by a wheel motor so that a type face to be used in printing is led to a printing position. The type wheel is then struck by a printing hammer. Then the type face presses an ink ribbon against a paper or the like to thereby carry out printing.

In printing, if type faces having different contact areas with an ink ribbon, for example, "W" and "." are struck completely in the same way, they are printed differently. Namely, "." is printed more densely than "W". In order to avoid such a problem, the working speed of a printing hammer is controlled according to type faces. In particular, the speed is fast when striking a type face with a large contact area with the ink ribbon (for example, "W"), and is slow when striking a type face with a small contact area with the ink ribbon (for example, ".").

In the conventional printer described above, time to select the next type face to be struck by driving the type wheel is based on the time taken to strike the type face with the smallest contact area with the ink ribbon (that is, when the working speed of the printing hammer is the slowest, and the time taken for striking is the longest). In this apparatus, when a type with a large contact area with the ink ribbon is printed, the latency time till the next type is selected is long, which causes a reduction in printing speed.

SUMMARY OF THE INVENTION

Accordingly, it is an object of the present invention to provide a printer with high printing speed by decreasing the dead time after one character is printed till the selection of the next type begins.

Briefly described, in accordance with the present invention, a printer comprises a type wheel, a hammer to hit the wheel, an ink ribbon, a carriage, detector means for detecting first and second positions of the hammer, and controller means responsive to the detector for generating the first and the second control signals to independently drive the type wheel, the ink ribbon, and the carriage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
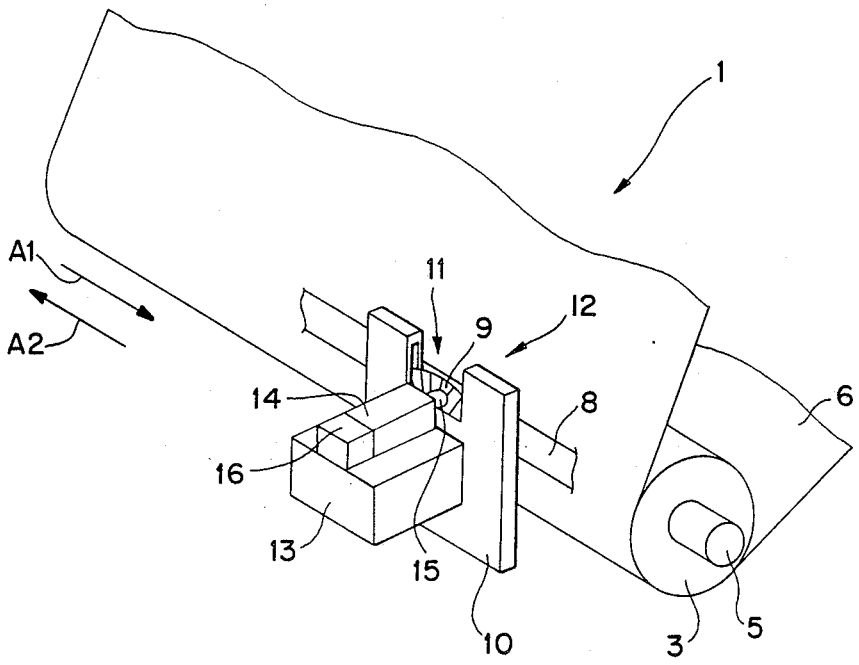
FIG. 1 is a partially enlarged perspective view of a typewriter as an embodiment of the present invention.
Figure 2:
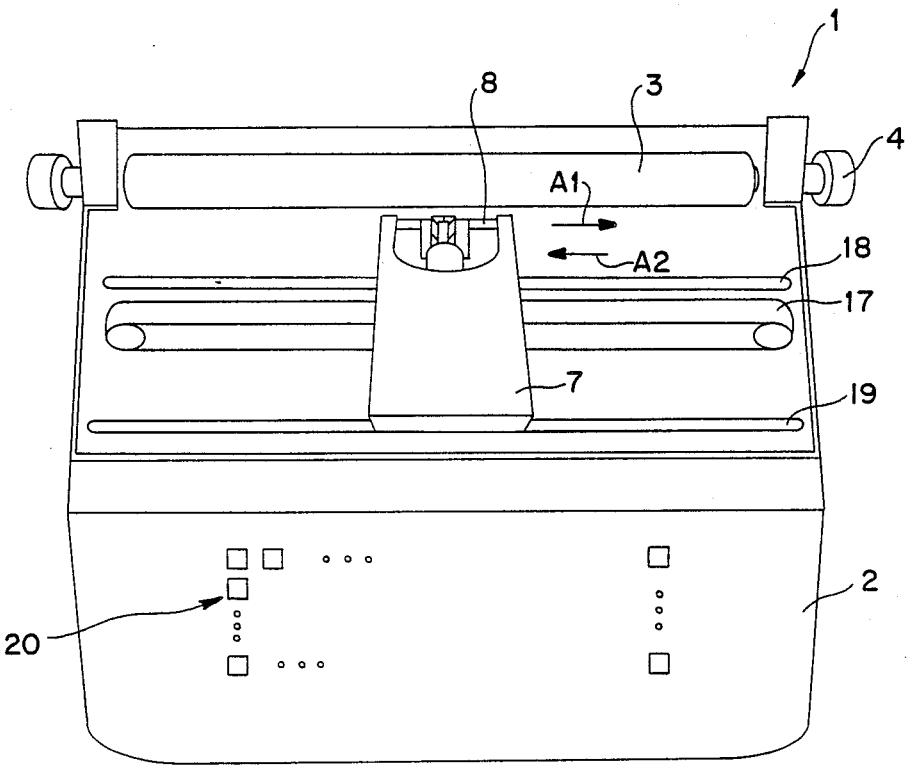
FIG. 2 is a perspective view of the typewriter.

FIG. 1 is a partially enlarged perspective view of a typewriter 1 as an embodiment of the present invention. FIG. 2 is a perspective view of the typewriter 1. The construction of the typewriter 1 comprises a platen roller 3 in a housing 2 of the typewriter 1. The platen roller 3 is made preferably of elastic material such as rubber and coaxially provided with a revolving shaft 5 which itself is connected to a platen knob 4.

A media 6, such as a printing paper sheet, is set around the platen roller 3. The platen roller 3 is confronted by a ribbon cartridge 7 for printing. An ink ribbon 8 is placed longitudinally along the platen roller 3. On the opposite side of the platen roller 3 in relation to the ink ribbon 8, a printer 12 is provided. The printer 12 comprises a housing 10 and a type wheel 11 stored therein. The type wheel 11 is supported by a fixed support 9 which is elastic and is shaped to form a vane wheel. The type wheel 11 is rotated by a wheel motor 24 the axis of rotation of which extends from the housing 10 toward the platen roller 3.

Figure 3:
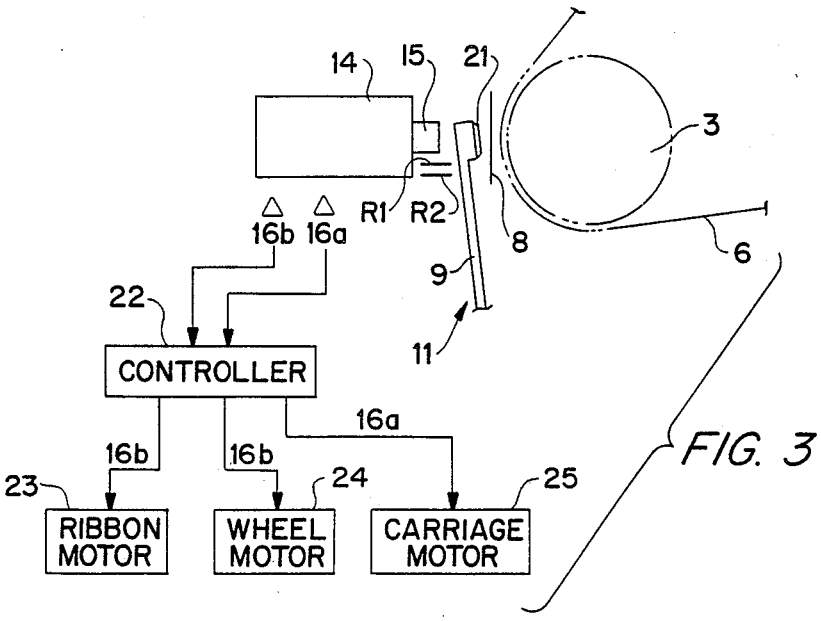
FIG. 3 is a system diagram showing the construction of a part of the typewriter relating to the printing hammer.

The support 9 of the printer 12 is arranged on the opposite side of the platen roller 3 with respect to the printer 12. The support 9 is hit by a projecting member 15 of the printing hammer 14 which hammer is a driving means fixed to the carriage 13. The support 9 then collides with the media (paper sheet) 6 through an ink ribbon 8. Printing is thus carried out. In the carriage 13, two detectors 16a and 16b (preferably two photo interrupters) are also provided as detecting means for the printing hammer 14. The printer 12, printing hammer 14, and detectors 16a, 16b, with the carriage 13, move in the directions of arrows A1 and A2 longitudinally along the platen roller 3 by a carriage motor 25 as seen in FIG. 3 and a will be described later. The carriage motor 25 is connected to a driving belt 17 as seen in FIG. 2. The driving belt 17 is moved along rails 18 and 19 by carriage motor 25.

On the typewriter 1, input key group 20 is provided. Desired letters or symbols are inputted through the input key group 20 and are printed on the printing paper sheet 6 by the abovementioned construction.

Figure 4:
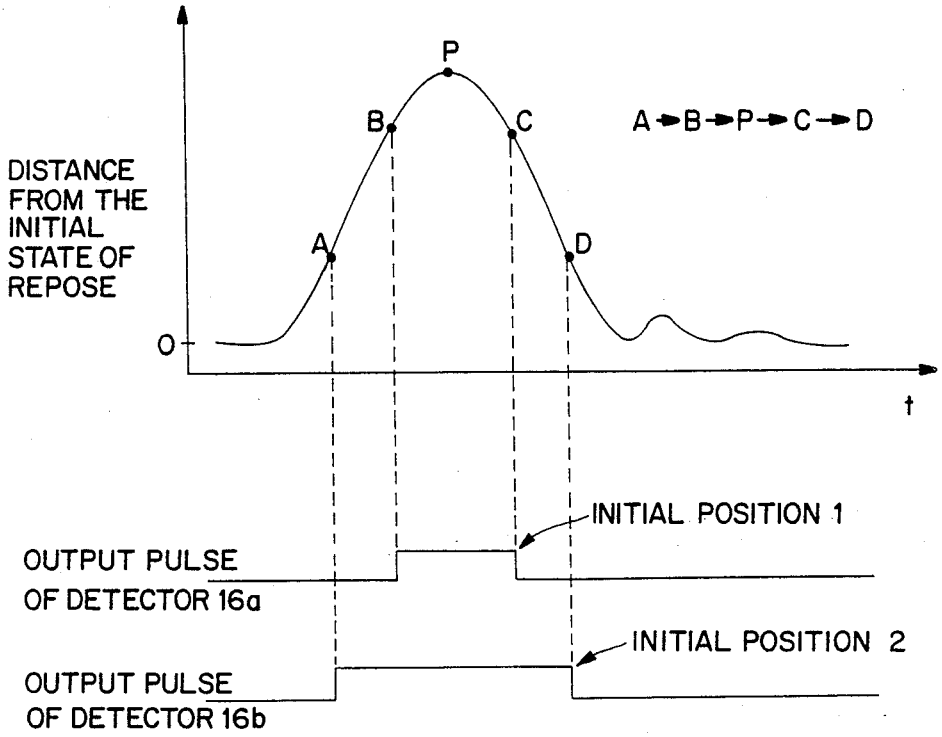
FIG. 4 is a graph which shows the distance moved by the printing hammer from the initial state of repose in accordance with time passed and output pulse of the detectors 16a and 16b responsive to the printing hammer's distance.

FIG. 3 is a system diagram which shows the construction of a part relating to the printing hammer 14. FIG. 4 is a graph showing the distance of the printing hammer 14 from the initial state of repose in accordance with time passed and output pulses of the detectors 16a and 16b responsive to the printing hammer's distance. The printing hammer 14 is preferably an electromagnetic plunger. The projecting member 15 of the printing hammer 14 is moved in the direction of arrow R1 and strikes the support 9 of the type wheel 11 (A - B - P in FIG. 4). A typeface 21 collides with the printing paper sheet 6 around the platen roller 3 through an ink ribbon 8 and printing is carried out. After that, the projecting member 15 moves in the direction of arrow R2 and is first reset to the initial position 1 (C in FIG. 4), and is secondly reset to the initial position 2 (D in FIG. 4).

The moving speed of the projecting member 15 varies according to the typeface selected. For example, the speed is fast when the typeface has a large contact area with the ink ribbon 8 (for example, "W"), and the speed is slow when the typeface has a small contact area with the ink ribbon 8 (for example, "."). The pressure given to the printing paper sheet 6 by the typeface 21 is thus kept constant and the density of printing is equalized.

The location of the back end is detected by the detectors 16*a* and 16*b*. The back end of the printing hammer means is the end opposite to the end which faces the typeface. The detector 16*b* is positioned so as to detect when the printing hammer 14 reaches the place D (initial position 2) far enough from the typeface for the ink ribbon 8 to be wound and for the next typeface to be chosen, by detecting the pulse falling as in FIG. 4. The detector 16*a* is positioned to detect when the printing hammer 14 reaches the place C (initial position 1) far enough for the carriage 13 to be moved, by detecting the pulse falling as in FIG. 4.

When the projecting member 15 is reset to the initial position 1 (that is, when the printing hammer 14 is far enough for the carriage 13 to move), the detector 16*a* detects this positioning and outputs signals to a controller means or controller 22. The controller 22 drives the carriage motor 25 according to the signals, thus the carriage 13 begins to move to the next printing position. Next, when the projecting member 15 is reset to the initial position 2 (that is, when the printing hammer 14 gets far enough for the ink ribbon 8 to be wound and for the next typeface to be chosen), the detector 16*b* detects it and outputs signals to the controller 22. The controller 22 drives a ribbon motor 23 and a wheel motor 24 according to the signals, thus winding of the ink ribbon 8 and selection of the next typeface is made.

Figure 5:
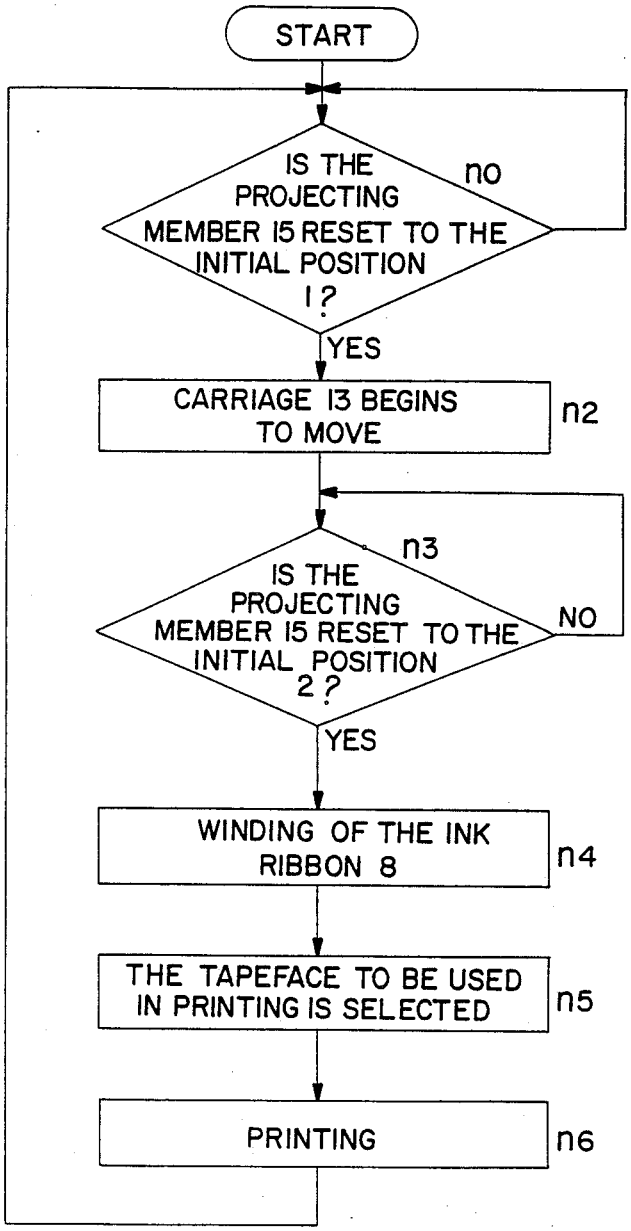
FIG. 5 is a flow chart of printing operation.

FIG. 5 is a flow chart of printing operation for the typewriter 1. The printing operation is explained hereinafter. When printing processing is instructed by an operator, first, step n1 is processed. The detector 16*a* detects whether the projecting member 15 is in the initial position 1. If the projecting member 15 is not in the initial position 1, the process does not go to the next step until it is reset to the initial position 1.

If it is decided that the projecting member is in the initial position 1, at the step n0, by the instruction of the controller 22, the carriage motor 25 is driven and the carriage begins to move. At the next step n3, the detector 16*b* detects whether the projecting member 15 is in the initial position 2. If the projecting member 15 is not in the initial position 2, the process does not go to the next step until it is reset to the initial position 2.

If it is decided that the projecting member is in the initial position 2, at the step n4, by the instruction of the controller 22, the ribbon motor 23 is driven and the winding of the ink ribbon 8 is done. At the next step n5, by the instruction of the controller 22, the wheel motor 24 is driven, the type wheel 11 is rotated, and the typeface to be used in printing is selected. Then, at the next step n6, the projecting member 15 of the printing hammer 14 strikes the support 9 of the type wheel 11. The typeface 21 collides with the printing paper sheet 6 around the platen roller 3 through the ink ribbon 8 such that printing is carried out. Then, the carriage 13 is driven and the printing position is advanced and the process goes back to the step n0. At the step n0, until the projecting member 15 goes back to the initial position 1, the content is regarded as negation and the process does not go to the next step. When the projecting member 15 is reset to the initial position 1, the process at the step n2 is carried out. The same can be said for step n3.

In the abovementioned way, in the present invention, when the projecting member 15 is reset to the initial position 1, the carriage 13 quickly begins to move, and when the projecting member 15 is reset to the initial position 2, winding of the ink ribbon 8 and selection of the typeface is quickly done. If the projecting member 15 goes back to the initial position early, the process goes to the next step early. Consequently, the printing speed increases. For example, in case that the difference between the working speed of a printing hammer when striking a typeface with the largest contact area and that when striking a typeface with the smallest contact area is 7 ms, the time required to print out one (1) page is (if characters stored in the machine are printed at once), shortened by at least 5 percent to 10 percent. Also, winding of the ink ribbon 8 and selection of the typeface is done after detecting that the projecting member 15 is in the initial position 2, so if the projecting member 15 is for some reason moved in the direction of the arrow R1 in FIG. 3 and fixed, the operation of the typewriter 1 is stopped and the wheel motor 24, etc. is not driven. Damage of the type wheel 11, for example, due to malfunction of the printer is thereby prevented and the durability of the printer is improved.

In the abovementioned embodiment, a typewriter with a type wheel having a support in the form of a vane wheel is used; however, it is clear that this invention is easily applied to a typewriter with type faces in a form of a golf ball or in a form of a cylinder.

Also, the abovementioned embodiment is a so-called electronic typewriter, but this invention can be easily applied to printers in a wide range, such as a printer connected to a computer.

While only certain embodiments of the present invention have been described, it will be apparent to those skilled in the art that various changes and modifications may be made therein without departing from the spirit and scope of the present invention as claimed.

What is claimed is:

1. A printer comprising:

a type wheel;

a hammer to hit said wheel;

an ink ribbon;

a carriage;

detector means for detecting first and second positions of said hammer, said hammer in the first position being positioned sufficiently far from said type wheel whereby said carriage can move without interference therefrom; and controller means responsive to said detector means for generating first and second control signals when said hammer reaches said first and second positions, respectively for independently driving said type wheel, said ink ribbon, and said carriage, said controller means driving said carriage when said hammer reaches the first position.

2. The printer of claim 1, wherein said second position of said hammer is where the hammer is positioned sufficiently far from said type wheel for said ink ribbon to be wound and for said type wheel to be rotated for selection of a next character to be printed.

3. The printer of claim 1, wherein said detector means is a photo interrupter.

4. A printer comprising:

a type wheel;

means for moving said type wheel;

hammer means for hitting said type wheel, said hammer means being movable at least between a first and second position;

an ink ribbon;

means for moving said ink ribbon;

a carriage;

means for moving said carriage;

detector means for detecting when said hammer means reaches said first position and said second position; and controller means responsive to said detector means for generating first and second control signals when said hammer means reaches said first and second positions, respectively, means transmitting said first signal to actuate said means for moving said carriage, means for transmitting said second signal subsequent to said transmission of said first signal to said means for moving said type wheel and said means for moving said ink ribbon to move said type wheel and ink ribbon, respectively, whereby said carriage can begin to move before said type wheel and ink ribbon begin to move.

5. The printer as recited in claim 4, wherein said hammer means in said first position is closer to said ink ribbon than when in said second position.

6. The printer as recited in claim 4, wherein said hammer means includes a projection member which reciprocates at least between said first and second positions.

7. The printer as recited in claim 4, wherein said controller means prevents said means for moving said type wheel from moving said type wheel until said detector means detects said hammer means reaching said second position whereby damage to the type wheel is avoided if the printer malfunctions.

* * * * *